US007329068B2

(12) United States Patent
Ungurean

(10) Patent No.: US 7,329,068 B2
(45) Date of Patent: Feb. 12, 2008

(54) GRID LOCKED STIFFENED PANELS WITH INTERLOCKING FEATURES

(75) Inventor: Dragos Ungurean, Canton, GA (US)

(73) Assignee: Universal Alloy Corporation, Canton, GA (US)

( * ) Notice: Subject to any disclaimer, the term of this patent is extended or adjusted under 35 U.S.C. 154(b) by 0 days.

(21) Appl. No.: 11/290,053

(22) Filed: Dec. 1, 2005

(65) Prior Publication Data

US 2006/0165486 A1 Jul. 27, 2006

Related U.S. Application Data

(60) Provisional application No. 60/641,945, filed on Jan. 7, 2005.

(51) Int. Cl.
*E01C 5/16* (2006.01)

(52) U.S. Cl. ..... 404/35; 405/302.4

(58) Field of Classification Search ..... 405/302.4; 404/19, 35, 36; 52/125.2, 177, 664
See application file for complete search history.

(56) References Cited

U.S. PATENT DOCUMENTS

| | | | | |
|---|---|---|---|---|
| 2,294,550 | A | 9/1942 | Greulich | 94/13 |
| 2,737,093 | A | 3/1956 | Greulich | 94/13 |
| 3,202,067 | A | 8/1965 | Michard et al. | 94/4 |
| 3,319,543 | A | 5/1967 | Braeuninger et al. | 94/13 |
| 3,372,466 | A | 3/1968 | Scholl | 29/475 |
| 3,385,182 | A | 5/1968 | Harvey | 94/13 |
| 3,385,183 | A | 5/1968 | Kortz | 94/13 |
| 3,538,819 | A | 10/1970 | Gould, Jr. et al. | 94/13 |
| 3,635,130 | A | 1/1972 | Perry | 94/13 |
| 3,984,961 | A | 10/1976 | Chieger et al. | 52/593 |
| 4,373,306 | A | 2/1983 | Rech | 52/98 |
| 4,440,363 | A | 4/1984 | Brand | 244/144 R |
| 4,488,833 | A | 12/1984 | Perry et al. | 404/35 |
| 5,050,362 | A * | 9/1991 | Tal et al. | 52/588.1 |
| 5,735,097 | A * | 4/1998 | Cheyne | 52/489.1 |
| 5,881,508 | A * | 3/1999 | Irvine et al. | 52/177 |
| 6,007,271 | A | 12/1999 | Cole et al. | 404/35 |
| 6,089,784 | A * | 7/2000 | Ardern | 404/41 |
| 6,733,206 | B2 | 5/2004 | Stasiewich et al. | 404/41 |

* cited by examiner

*Primary Examiner*—Tara L. Mayo
(74) *Attorney, Agent, or Firm*—Andrew Alexander

(57) ABSTRACT

Panel for aircraft landing strip.

9 Claims, 10 Drawing Sheets

GRID LOCKED STIFFENED PANELS WITH INTERLOCKING FEATURES

CROSS REFERENCE TO RELATED APPLICATION

This application claims the benefit of U.S. Provisional Application No. 60/641,945, filed Jan. 7, 2005, incorporated herein by reference.

BACKGROUND OF THE INVENTION

This invention relates to interlocked stiffened panels and more particularly to aluminum extruded panels suitable for use as aircraft landing mats.

In the building of temporary air fields, landing mats or panels, which can be locked together with the minimum of tools, are used. The prior panels required a watertight construction, and thus included significant welding. The strength of such panels was provided by a truss structure. However, such panels have the problem of being heavy and bulky. This results in high volume that does not permit maximum transportation pay load. For example, if the thickness can be reduced from two to one inch, this results in double the pay load. Thus, there is a great need for a slim yet strong mat or panel that lends itself to economic transportation and quick and efficient assembly.

Examples of floors and landing mats are provided in the references. For example, U.S. Pat. No. 3,635,130 discloses an improved landing mat installation and the like comprised of a plurality of removably interlocked panels, wherein the joints formed by various marginal edges of the panels are provided with improved cooperating locking and sealing means that advantageously inhibit the penetration of water and the like through the joints as well as facilitating the installation and dismantlement of the panels making up the landing mat installation.

U.S. Pat. No. 4,440,363 discloses a landing mat for compacted terrain formed by assembling a multiplicity of mat elements in contiguous relationship. Each of these elements has a rectangular plan configuration and is formed along its longitudinal edges with downwardly bent flanges, and between these flanges, with flattened corrugations forming longitudinal ribs perpendicular to the planar upper surface of the element. Stabilizing plates can extend transversely to the ribs and flanges and can have upwardly open slots snugly receiving the ribs. Clips bridging contiguous edges of adjoining elements are fitted into elongated windows spaced inwardly of these edges to hold the elements together and an edge member, likewise having a flattened-corrugation rib, is fixed along one edge of the mat and has downwardly turned tongues fitted into the window of the elements along the latter edge.

U.S. Pat. No. 2,737,093 discloses a metal mat adapted to be laid side by side with like mats to form an airfield deck, the mat comprising a ground plate having corrugations extending lengthwise thereof and forming laterally spaced troughs, a deck plate secured to the top of the ground plate between the troughs, cooperative connecting means on the opposite sides of the deck plate for connection to the deck plate of an adjoining mat to interlock the mats, the deck plate being provided with a plurality of longitudinally spaced openings above troughs of the ground plate, vertical struts extending downward from the deck plate to the bottoms of the troughs for spacing the deck plate and the bottoms of the troughs apart when the mat is supporting a load, the struts extending transversely of the troughs with their upper ends connected by integral bends to the sides of the openings, and a trough-like connecting member slidably disposed in one end of a trough and adapted to be slid part way out of the trough and into an aligned trough of another mat to connect the adjoining ends of the two mats, the upper part of the connecting member being provided with a bendable ear, and the deck plate being provided with an opening for receiving the ear when it is bent upward to lock the connecting member against longitudinal movement.

U.S. Pat. No. 3,372,466 discloses a continuous process for manufacturing a metal landing mat comprising rolling two identical hot slabs simultaneously by opposed pairs of pressurized rollers to form hot identical waffle-like half mats having one corrugated side and one flat side, and arranged to discharge from the rollers with their corrugated sides inward; feeding the half mats into coordinated contact so that the corrugations of one half mat contact the corrugations of its companion half mat in abutting relationship; and pressure rolling the hot half mats to weld the opposed half mats at all points of contact.

U.S. Pat. No. 2,294,550 discloses a plurality of metallic plates adapted for rapid attachment and detachment to form a substantially horizontal portable deck capable of sustaining superposed loads, each of the plates having a series of aligned spaced openings inwardly of an edge thereof, and being provided outwardly of the openings with a series of aligned spaced downwardly-projecting lugs adapted to align with, and extend through, the openings of a similarly formed and adjacently disposed plate, each of the lugs comprising a shank and an enlarged head portion, the openings in the plates being substantially larger than the enlarged head portions of the lugs thereof whereby, upon disposing the lugs in the the openings and subjecting the plates to relative longitudinal movement, the enlarged head portions of the lugs of one of the plates are disposed beneath the bottoms of the similarly formed and adjacently disposed plate to thereby effect an interlock.

U.S. Pat. No. 3,319,543 discloses a structural unit comprising elongated plate-like top and bottom members joined by spaced apart longitudinally extending web members which run from end-to-end of the top and bottom members. The top and bottom members and the web members define a plurality of channels when viewed in transverse cross-section. A plurality of tubular elements are provided and each of the tubular elements are dimensioned to fit closely but slidably into one of the channels. The length of the tubular elements is a minor fraction of the length of the unit, the tubular elements being disposed within the channels with an end of each of the channels being coextensive with the end of one of the web members. The end of the channels and the end of the web members are welded together. The end parts of the top and bottom members and the tubular elements are beveled whereby the top of the tubular elements and the top and bottom parts of the web members are exposed, and an elongated end coupling element is received on the beveled surfaces. The coupling element is welded to the top and bottom members, the top and bottom parts of the tubular elements, and the top 30 and bottom parts of the web members.

U.S. Pat. No. 3,385,182 discloses metallic load bearing plank for use with other similar planks in assembly of a horizontally disposed platform for movement of vehicles over uneven terrain, for aircraft landing mats, and the like, in which a plurality of load bearing planks are interlocked to prevent substantial vertical and horizontal movement relative to each other while providing for easy assembly and permitting normal expansion and contraction due to temperature change. The metallic load bearing plank comprises an elongated unitary body portion having an upper substantially flat slab surface and a lower substantially flat slab surface, which upper and lower slab surfaces are interconnected by vertically disposed load bearing ribs, continuous female interconnecting means formed integral with the body portion of the plank means and extending along one longitudinal side of the body portion. A continuous male interconnecting means is formed integral with the body portion of the plank means and extends along the remaining longitudinal side of the body portion. The continuous female and male interconnecting means is complementary with male and female inter connecting means respectively on similar metallic load bearing planks. The continuous female interconnecting means defines a vertically disposed pocket means opening upwardly in a direction transverse to the upper slab surface along the one longitudinal side of the body portion. A horizontally disposed pocket means opening is disposed in a direction substantially parallel to the lower slab surface and spaced from the lower slab surface in the direction of the upper slab surface.

U.S. Pat. No. 3,385,183 discloses a modular load bearing platform comprising a multiplicity of similar rectangular load bearing planks arranged in a number of parallel rows each containing several planks disposed in end-to-end relation, each plank including first and second end connecting means along its end edges, respectively, and first and second side connecting means along its side edges, respectively. The first and second end connecting means has complementary shapes and is adapted for releasably interlocking engagement with the end connecting means on adjacent planks in the platform. The several planks in each plank row are releasably joined in end-to-end relation by interlocking engagement of the first end connecting means on each plank with the second end connecting means on an adjacent plank in the respective row.

U.S. Pat. No. 3,538,819 discloses a novel and improved assembly of matting elements that provide a suitable structural planar surface for aircraft takeoff and landing operations. The component mats or modules of the assembly are interconnected and interlocked to restrict relative movement therebetween by providing each mat with one or more locking pins that are disposed between upper and lower planar surfaces of each mat and slide between a nonlocking position where the pin is fully withdrawn in the mat and a locking position where the pin projects outwardly from its associated mat and engages an adjoining mat.

U.S. Pat. No. 4,373,306 discloses a structural element, such as a section of a duckboard (e.g. a landing mat) to be removably fastened to a similar section, has one or more edges provided with male coupling formations adapted to be converted into complementary female formations by breaking off a projecting part thereof. The projecting part is generally T-shaped, with its frangible stem rising from the bottom of a preferably dovetail-shaped recess. Such an element can therefore be readily joined to another element having a mortise complementary to the head of the T or a tenon complementary to the recess.

U.S. Pat. No. 6,007,271 discloses a mat used as a ground engagement platform for supporting heavy equipment or as a road surface for supporting vehicular traffic. The use is intended to be temporary, with the mats being reusable. The mat, in its basic construction, includes a flat plate-like structure having a thickness and planar extent and an opening defined in the flat plate-like structure which extends in the thickness direction and is dimensioned to receive a lifting device for lifting and transporting the mat.

U.S. Pat. No. 4,488,833 discloses a transportable modular assault vehicle water egress and bridge access/egress surfacing or trackway system wherein a plurality of rectangularly shaped planks or sections are joined by flexible hinge members and can be folded accordion fashion and suspended in a container for storing, transporting and rapidly deploying to provide a surfacing upon the shores or banks of bodies of water for the access and egress of military vehicles into and out of bodies of water during military operations.

U.S. Pat. No. 3,984,961 discloses a solution to the problem of distortion and deformation of the floor of a light weight shipping container. Heretofore, relatively heavy loading of lightweight shipping containers has caused the floor thereof to deflect sufficiently to distort the side walls and end walls of the container and often permanently deform the floor. In practicing the present invention, the floor boards adjacent the side walls of the container are modified so as to increase the resistance thereof to shear loads and thus minimize deflection.

U.S. Pat. No. 6,733,206 discloses a ground cover mat which includes a first end interlock at a first end of the body which is adapted to interlock with a second end interlock at a second end of a like body. A second end interlock is provided at the second end of the body which is adapted to interlock with the first end interlock at a first end of a like body. A first side interlock is provided at a first side of the body which is adapted to interlock with a second side interlock at a second side of an adjacent like body. A second side interlock is provided at the second side of the body which is adapted to interlock with the first side interlock at a second end of an adjacent like body.

From these references, it will be seen that there is still a great need for a slim yet strong landing mat having high strength suitable for use as a temporary landing field for aircraft.

SUMMARY OF THE INVENTION

It is an object of the invention to provide an improved aircraft landing mat.

It is another object of this invention to provide a less bulky and stronger aircraft landing mat.

It is another object of this invention to provide an improved landing mat comprising an interlocked top and bottom panel.

It is a further object of this invention to provide an improved landing mat comprising extruded aluminum panels.

These and other objects will become apparent from the specification, drawings and claims appended hereto.

In accordance with these objects, there is disclosed an improved panel suitable for use in forming a temporary aircraft landing strip. The panel is comprised of a top side and a bottom side. The top side comprises a multiplicity of generally rectangular extruded members having a flat upper surface and lower surface having reinforcing, downwardly extending ribs thereon. The top side has first and second side connection means thereon, the downwardly extending ribs on the top side are disposed substantially parallel to the first and second side connection means. The bottom side comprises a multiplicity of generally rectangular extruded members having a generally flat lower surface disposed substantially parallel with the top side, the bottom side having an upper surface having reinforcing upwardly extending ribs thereon. Each bottom side has a first and second end connecting means. The upwardly extending ribs on the bottom side are disposed substantially parallel to the first and second end connection means. The ribs on the top side cross the ribs on the bottom side at substantially 90°. The ribs on the top have slots formed therein, and the upwardly extending ribs on the bottom side are locked into the slots providing reinforcing ribs extending from end to end and side to side to form the panel. Thus, a reinforced panel is described having first and second end connection means along its end edges provided by the bottom side and first and second side connecting means along its side edges provided by the top side.

There is provided an improved temporary aircraft landing strip wherein a multiplicity of rectangular panels are locked together to form parallel rows of releasably joined panels disposed in a side-by-side relationship and in an end-to-end relationship. Each panel has a first and second end connecting means along its end edges releasably joining the panels in an end-to-end relationship to form a row. Also, each panel has a first and second side connecting means along its side edges, releasably connecting rows of the panels to form the strip. The improved panel is comprised of a top side and a bottom side. The top side comprises a multiplicity of generally rectangular extruded members having a flat upper surface and a lower surface having reinforcing, downwardly extending ribs thereon. The top side has first and second side connection means thereon, the downwardly extending ribs on the top side disposed substantially parallel to the first and second side connection means. The bottom side comprises a multiplicity of generally rectangular extruded members having a generally flat lower surface substantially parallel with the top side, the bottom side having an upper surface having reinforcing upwardly extending ribs thereon. Each bottom side has a first and second end connecting means. The upwardly extending ribs on the bottom side disposed substantially parallel to the first and second end connection means. The ribs on the top side cross the ribs on the bottom side at substantially 90°. The ribs on the top have slots formed therein, and the upwardly extending ribs on the bottom side are locked into the slots providing reinforcing ribs extending from end to end and side to side to form the panel. Thus, a reinforced panel is described having first and second end connection means along its end edges provided by the bottom side and first and second side connecting means along its side edges provided by the top side.

DETAILED DESCRIPTION OF THE PREFERRED EMBODIMENTS

Figure 1:
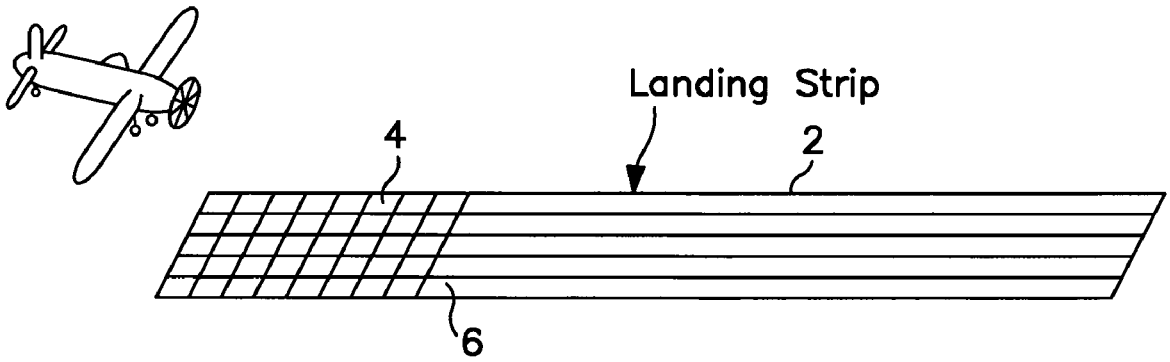
FIG. 1 is a perspective view of an aircraft landing strip incorporating mats or panels in accordance with the invention.

Referring now to FIG. 1, there is illustrated a landing strip 2 in accordance with the invention. The landing strip is comprised of multiple panels 4 which are substantially identical. It will be noted that the panels are arranged in parallel rows 6, each of which contain several panels arranged in an end-to-end relationship. That is, the panels are joined to each other, as explained herein. The panels may be arranged so panels in adjacent rows are staggered or offset in the length direction. This staggered arrangement provides improved strength because a joint terminates in the middle of the adjacent panel. Half panels would then be necessary at the ends to provide a finished or smooth end. Interlocking sides and ends are provided on the panels in order that the panels can be releasably joined.

Figure 2:
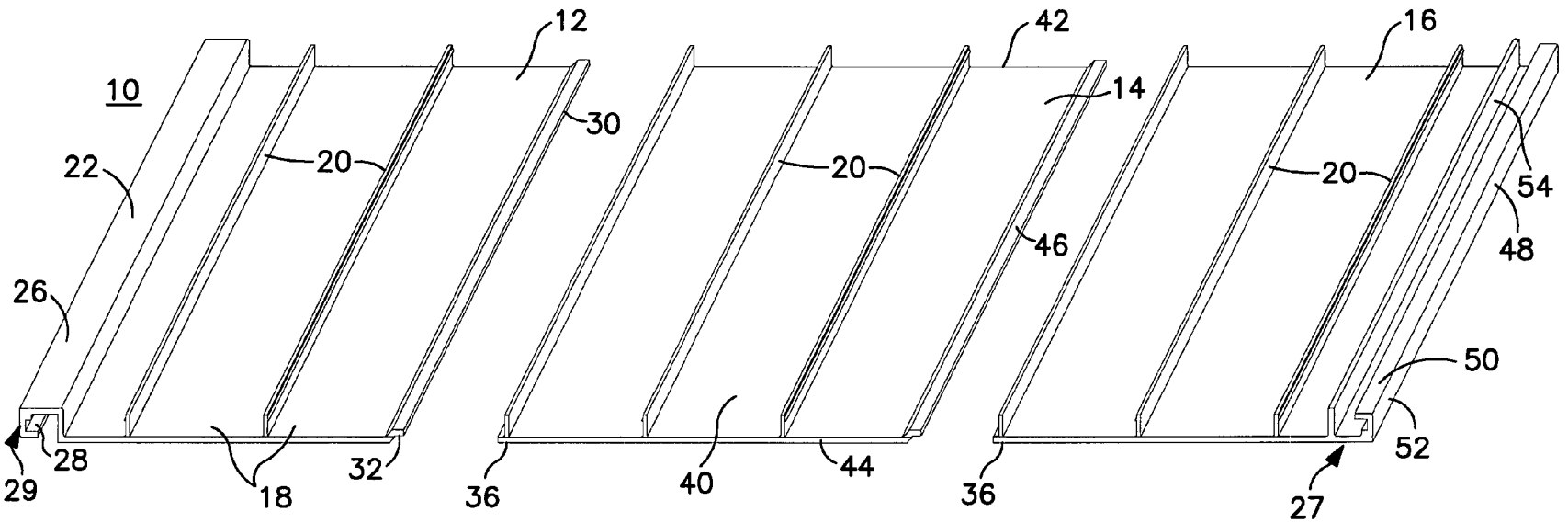
FIG. 2 is an exploded view showing panels used to make the bottom section of the landing panel.

Each panel is comprised of a top and bottom side, each of which sides are formed from several sections. A bottom side 10 is illustrated in FIG. 2 which is a horizontally exploded view comprised of three members, 12, 14 and 16. These members can be fitted together to form the bottom sides. Members 12, 14 and 16 are extruded members, and member 12, for example, is comprised of a flat or planar section 18 and reinforcing rib members 20. Further, extruded member 12 is provided with an interlocking channel section 22 which in the embodiment shown has sides 24, 26 and 28, and may be referred to as a first end interlocking engagement. It will be seen that side 28 has opening or is spaced away from side 24 to provide means for releasable interlocking with the next successive panel in a row, as will be explained herein. The opposed side 30 of member 12 or extruded so as to provide a lip section 32 to accommodate adjacent extruded member 14, which extends under lip section 32 to where it can be fastened in many different ways, depending on the application: friction stir welding, high strength aluminum adhesives, high strength/high density urethane foams, or other composites that adhere to aluminum.

It should be understood that while three extruded members are shown comprising panel bottom side, multiple members 14 can be used to extend the size of panel 10.

With respect to FIG. 2, it will be seen that extruded member 14 is comprised of a flat or planar section 40 having ribs 20 extending from edge 42 to edge 44. Also, side 46 is formed or extruded to provide a lip section 32 similar to that on extruded member 12 (see FIG. 11).

Figure 7:
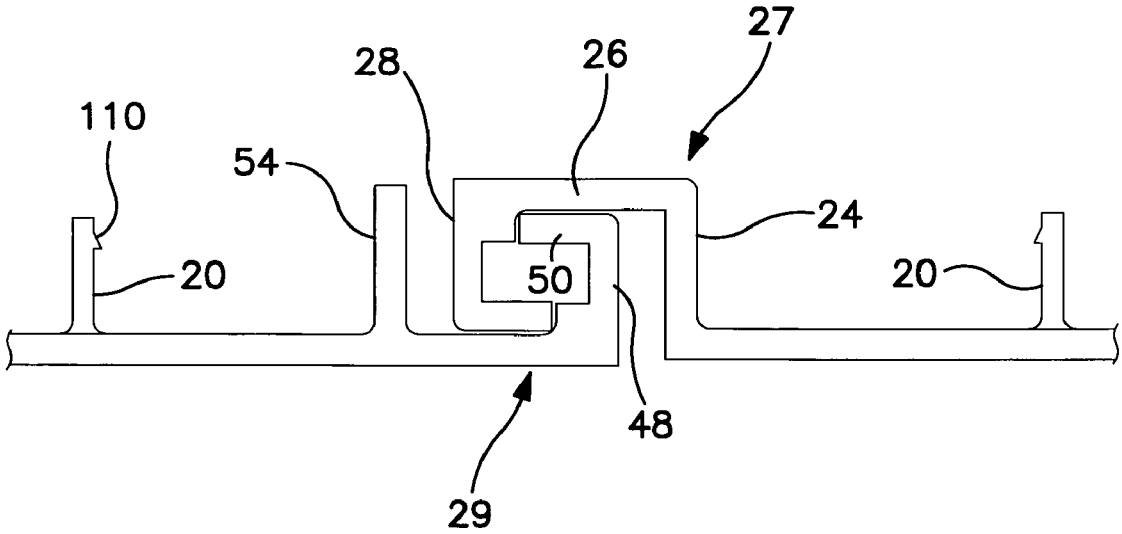
FIG. 7 is a cross-sectional view showing the end-to-end interlocking of the end engagement means.

Extruded member 16 is provided with a protrusion 36 similar to extruded member 14 and reinforcing ribs 20. Extruded member 16 is provided with an interlocking channel section 48, which in the embodiment shown has sides 50, 52 and 54, which may be referred to as a second end interlocking engagement. It will be noted that channel side 50 has an opening or is spaced away from channel side 54 to provide means for releasable interlocking with the complimentary channel of the next successive panel in a row (see FIG. 7).

Figure 3:
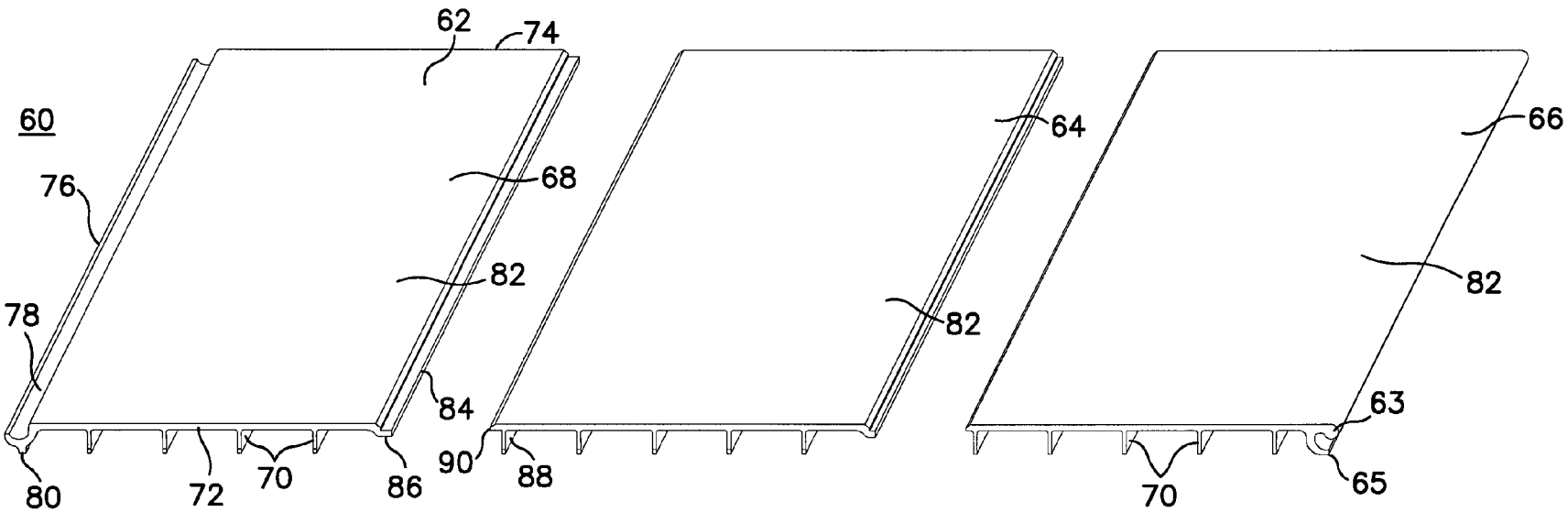
FIG. 3 is an exploded view showing panels used to make the top section of the landing panel.

Referring now to FIG. 3, there is shown top side 60 of panel 4 in an exploded form. Top side 60 is comprised of three extruded members 62, 64 and 66, two outside extruded members 62 and 66 and a middle extruded member 64. However, multiple middle extruded members 64 may be used, or top side 60 may be extruded as a unit without need for joining of extruded members. In the embodiment shown in FIG. 3, extruded member 62 is comprised of a flat portion 68 and ribs 70 extending from edge 72 to edge 74. Side 76 terminates in a curved portion 78. This is formed in an upward C-shape and is adapted to be accepted by the complimentary side of the adjacent panel. Curved portion 78 may be referred to as the first side connection means or the male connection means. Upward C-shaped channel 76 is provided with a short rib 80 to provide support. Surface 82 is shown substantially flat, but other type surfaces may be employed, depending on the end use. Opposed side 84 has a lip portion 86 which is formed or extruded downwardly about the thickness of flat portion 68 to accommodate adjacent extruded member 64 similar to that described for the bottom panels. Extruded member 64 has a horizontal member or portion 90 which extends beyond rib 88. Member 90 overlies lip portion 86 when the extruded members are assembled into a side.

Figure 8:
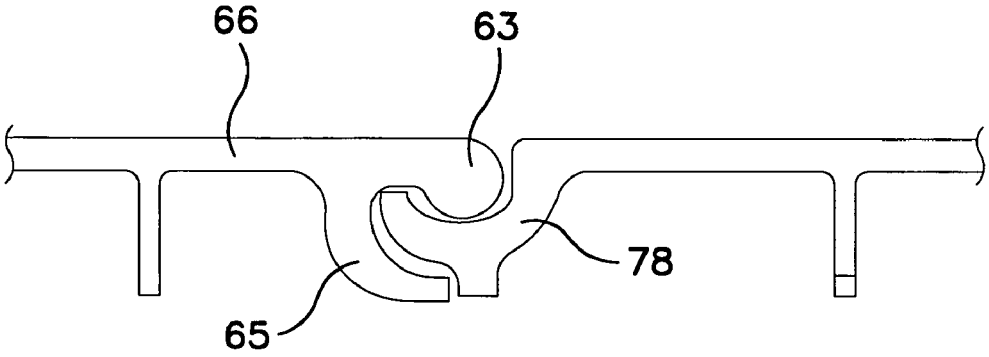
FIG. 8 is a cross-sectional view showing the side-to-side interlocking engagement means for adjacent rows.

As will be seen from FIG. 3, top side 60, in the embodiment shown, is comprised of a third extruded member 66 which is connected to extruded member 64 in the same way as extruded member 64 is connected to extruded member 62. In order to connect top side 60 to adjacent panels, member 66 is provided with a female connection means which permits hinging into the adjacent lateral panel having curved portion 78 as described with respect to extruded member 62. The connecting of adjacent panel using this hinging mechanism is shown in FIG. 8. It will be seen from FIG. 8 that a bead 63 is extruded on the edge of panel 66, which fits in and is supported by the upward C-shaped or cup section 78. A protrusion 65 curves underneath cup section 78 and locks top side 60 to the top side of the panel in the adjacent row. This provides a male and female side connection means on laterally adjacent panels in adjacent rows of panel where bead 63 and protrusion 65 define the walls of the female mechanism and cup-shaped member 78 defines the male connection mechanism.

Figure 4:
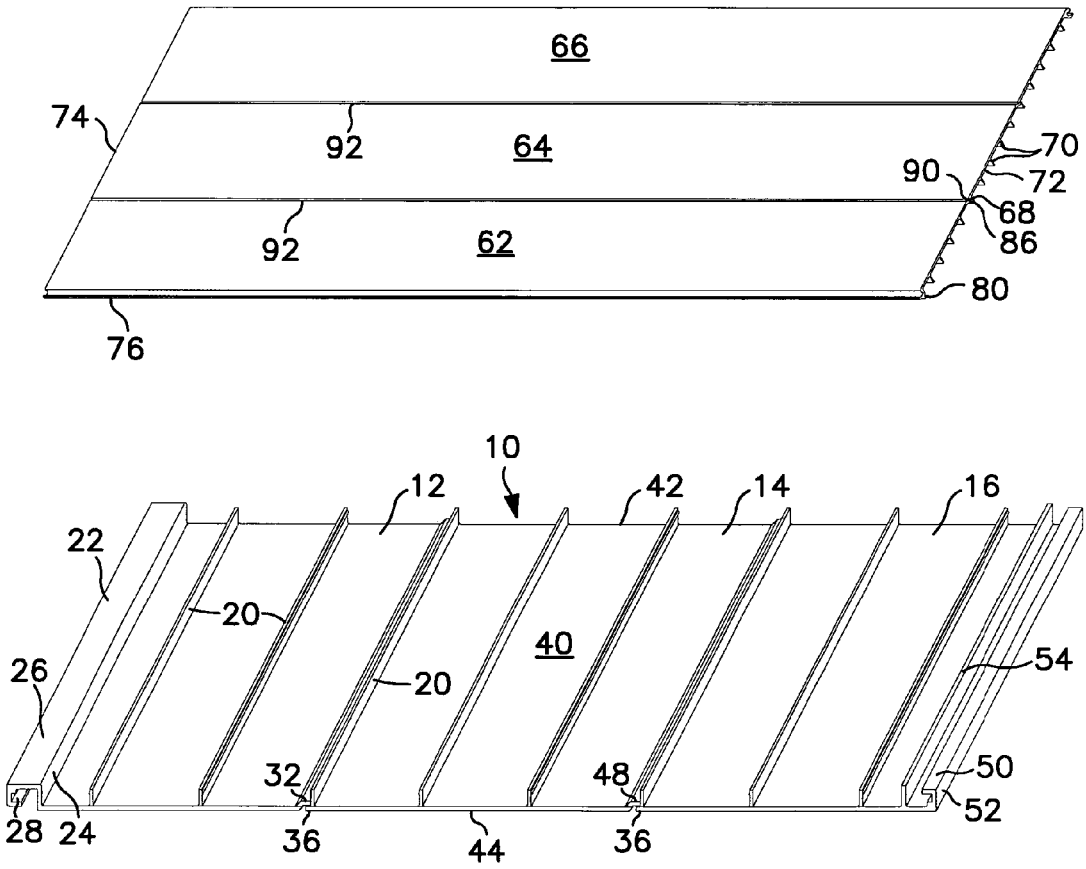
FIG. 4 is a perspective view showing the bottom section and the orientation of the top section.

FIG. 4 is an exploded view showing top side 60 superimposed over bottom side 10 of panel 4. The sides are comprised of extruded members fastened together. The fastening along seams 92 is achieved in different ways, depending on the application: friction stir welding, high strength aluminum adhesives, high strength/high density urethane foams, or other composites that adhere to aluminum. Other fastening means such as screws or rivets may be used to hold the members together. It is important to note that ribs 70 in top side 60 run counter to ribs 20 on bottom side 10. The ribs on top side 60 preferably are arranged across the ribs on bottom panel 10 at right angles.

While only one extruded member 64 or 40 is shown in both top side and bottom side, more than one extruded member may be used.

Figure 5:
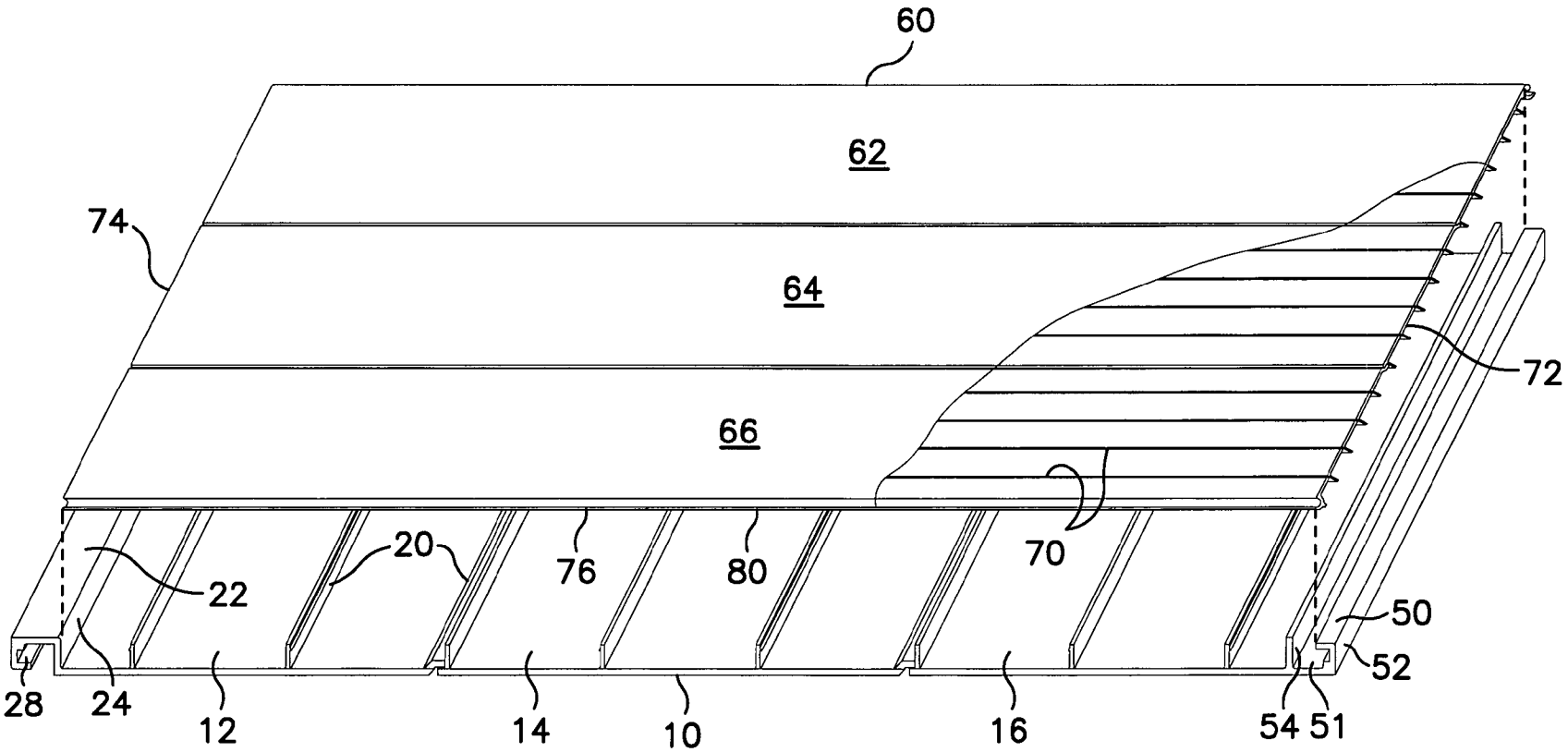
FIG. 5 is another perspective view showing the relationship of the top section to the bottom section prior to being locked together.

FIG. 5 is a perspective view of bottom side 10 and top side 60 just prior to being snapped together. It should be noted that top side 60 is lined up to fit within channels 22 and 54. That is, edge 72 abuts against rib 54, and edge 74 abuts against channel side 24. In this way, channel 22 is open to receive channel 51 of the next successive panel in the row, or the first end connecting means can interlock with the second end connecting means of the next successive panel in the row, thereby locking the panels together.

Figure 6:
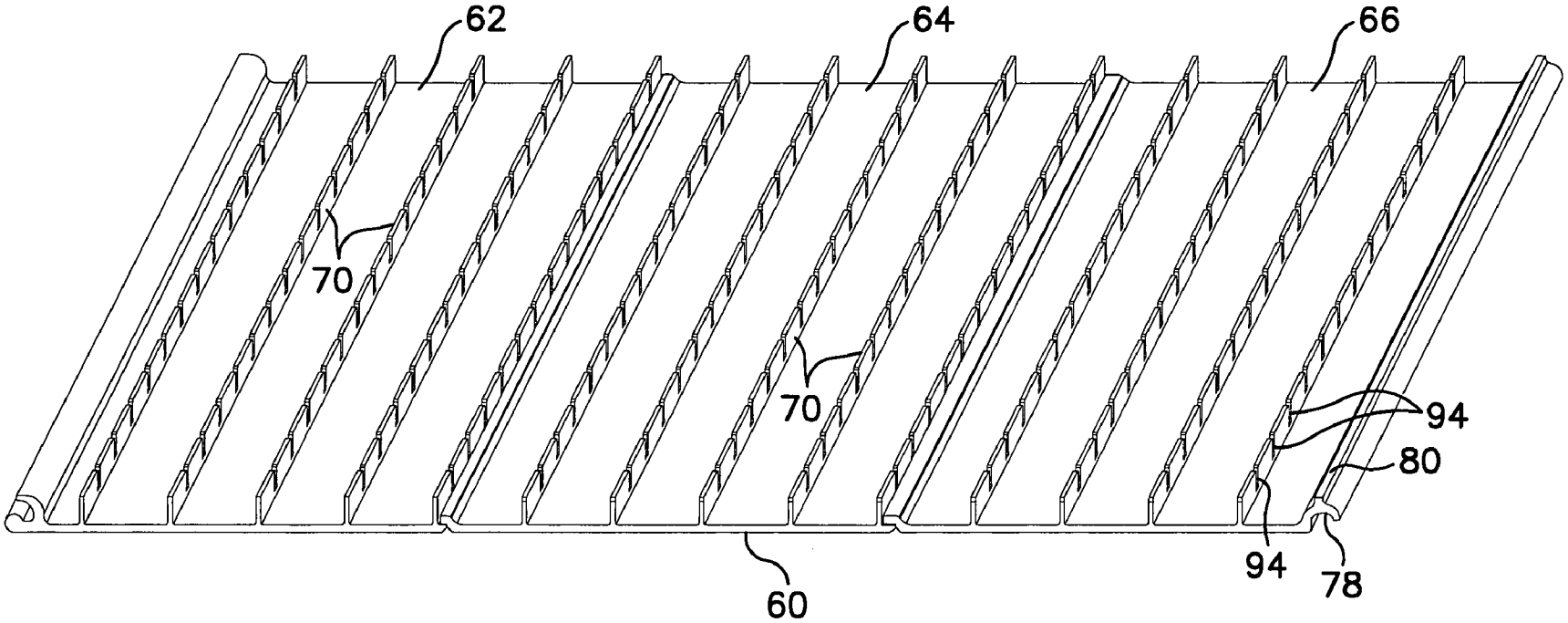
FIG. 6 is a view of the ribs on the top section showing the slots in the ribs.

To provide for top side 60 locking into bottom side 10, ribs 70 of top side 60 are provided with slots or openings 94 opposite each rib 20 on bottom side 10. This concept is shown in FIG. 6, which is a view of top side 60 with ribs and side turned upwardly to show slots 94. Thus, it will be noted that a slot is provided in all the ribs that encounter or cross over a rib on bottom side 10. This provides a very compact or thin panel with very high strength and it also facilitates high pay loads during transportation because of the high packing density.

Figure 9:
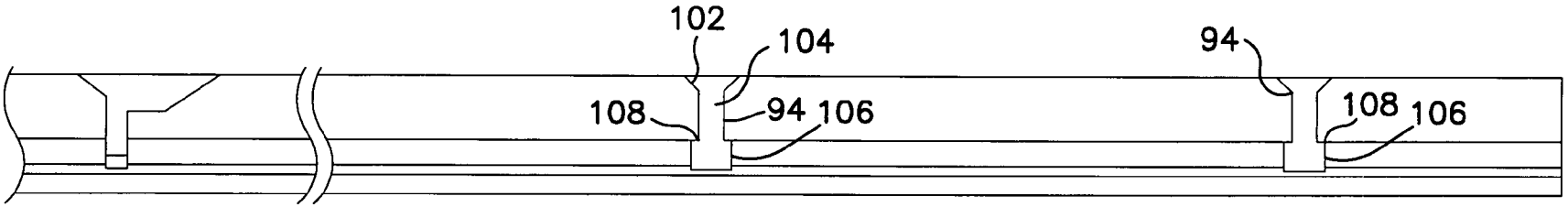
FIG. 9 is a view of a top rib showing slot configuration for locking with bottom ribs.
Figure 10:
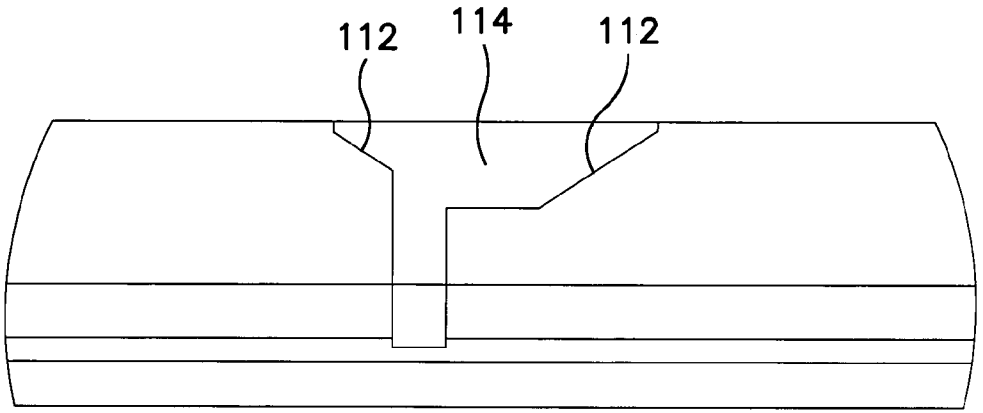
FIG. 10 is an enlarged view of a slot disposed opposite a joint in the bottom panel as shown in FIG. 11.

Slots 94 are more clearly shown in FIGS. 9 and 10. In FIG. 9, there is shown the preferred slots 94, which are formed in rib 70 of top side 60. It will be seen from an inspection of slots 94 that they are formed or machined to have a fluted opening 102 to facilitate insertion of ribs 20 thereinto. Slot 94 then has a narrower portion 104 followed by a rectangular or square shaped portion 106 having shoulders 108. Shoulders 108 serve to lock ribs 20 therein. It will be seen from FIG. 7 that rib 20 is provided with a protrusion 110, which when inserted into slot 94 locks the top and bottom sides of the panel together. That is, protrusion 110 latches or locks onto shoulder 108, firmly connecting rib 20 in slot 94.

Figure 11:
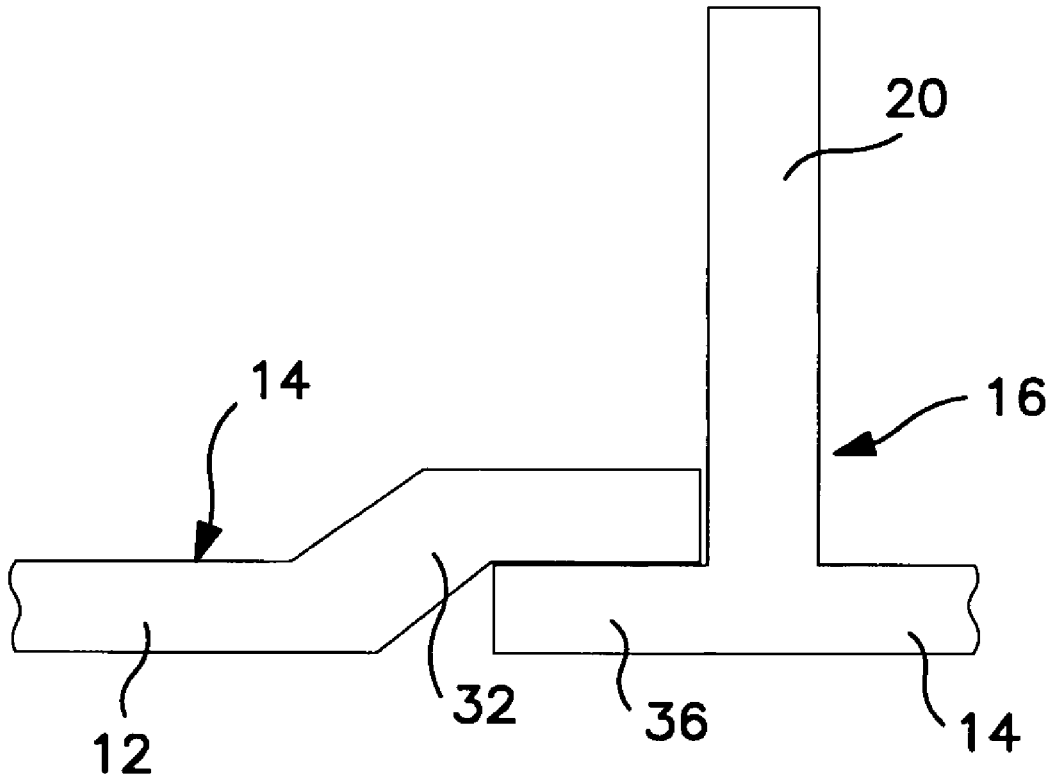
FIG. 11 is a cross-sectional view showing the locking configuration of the extruded members in the bottom section.

As noted earlier, bottom side 10 is formed from three members, which are connected as shown in the enlarged view of FIG. 11. In FIG. 11, 14 is the extruded member (FIG. 2) and 16 is the extruded member to which extruded member 14 is joined. As more clearly seen in FIG. 11, the raised portion 32 of extruded member 14 overlaps protrusion 36 of extruded member 16 and abuts rib 20. For this area to mesh with top side 60, rib 70 of top side 60 is required to have a slotted opening 110 shaped as shown in FIG. 10. Thus, opening 110 is provided with fluted sides 112. However, a section 114 of the rib is removed to accommodate lip section 32 (see FIGS. 4 and 11). This aids in providing a panel having minimum thickness and yet retains high strength values. Thus, it will be appreciated that for every joint in bottom side 10 there is required a slotted opening, as shown in FIG. 10.

Figure 12:
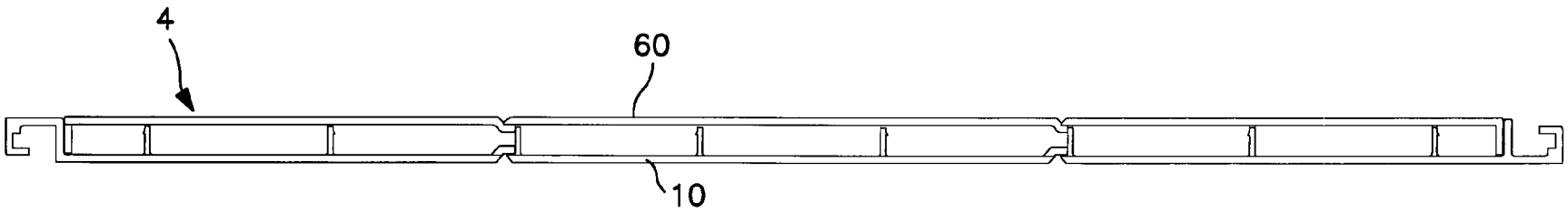
FIG. 12 is a cross-sectional view showing the top and bottom section locked together to form a panel easily connected to the end of successive panels in a row to form a landing strip.
Figure 13:
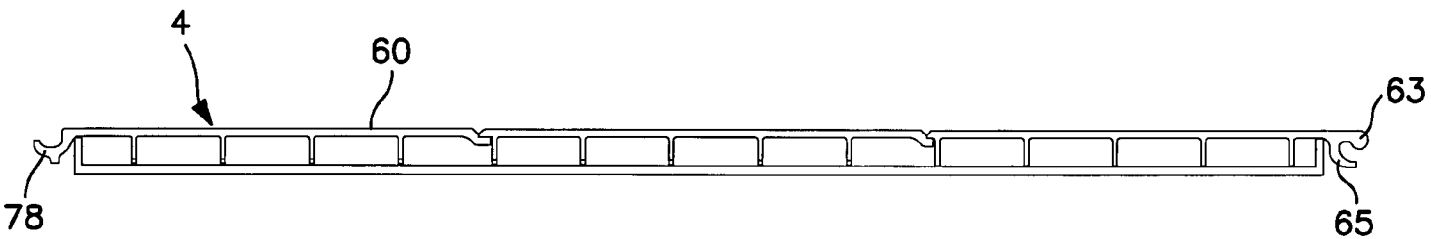
FIG. 13 is another cross section of the panel showing sides which can be easily joined to panels in adjacent rows.

FIGS. 12 and 13 show a cross section of top side 60 and bottom side 10 in the assembled mode.

In laying landing strip 2, panels 4 in each of rows 6 are releasably connected in an end-to-end relationship by interlocking of the end connecting means 27 with that of 29, which is on the next successive panel on the same row. Also, the row adjacent is releasably connected by engagement of male 78 and female connecting means as defined by protrusions 65 and 63 (FIG. 8). Top 26 of one panel and the under connection lip 50 are machined to create a slot to slide in a connection bar. The connection bar can be put in from the end of the panel, but that defeats the purpose of changing one damaged panel without dismantling the entire runway.

Thus, in assembly of the landing strip, panels 4 are placed on the ground in such a way that the open connecting end 27 is facing upwardly starting with the panel at the beginning of a row. The next panel in the row is lowered so that open connecting end 29 which faces downwardly is lowered into upwardly facing connecting end 27 of the preceding panel to provide a mating engagement. This procedure is carried out for the remainder of the row. The landing strip is created by a brick layout design wherein the panels will interlock longitudinally with two panels intersecting on the center of another panel.

The engagement of the panel in the adjacent row using the side connecting means is somewhat more difficult because it does not simply fall into place as with previously described end-to-end engagement. Thus, for purposes of engaging panels in the laterally adjacent row, the panel must be rotated upwardly. Then, the panel is moved towards the row panel to a position wherein the female connecting means, as defined by protrusions 65 and 63, is disposed over the male connecting means 78. Thereafter, the panel is lowered to the same level as the panels in the laterally adjacent row, thereby completing the interlocked position (see FIG. 8). Thus, the side-by-side connection of adjacent panels is completed. It will be noted that disengagement of the panel easily follows the reverse procedure.

The panels may be fabricated from aluminum alloys such as 5083, 2024, 7075, 7249, 7136 and 6061. Other material can include adhesives, composites, urethane, polyurethane, or other chemicals suitable for the application. The panels can have a thickness in the range of 0.500 to 1.5 inches.

Having described the presently preferred embodiments, it is to be understood that the invention may be otherwise embodied within the scope of the appended claims.

What is claimed is:

1. A panel suitable for use in forming a temporary aircraft landing strip, the panel comprised of:

(a) a top side comprising:

(i) a multiplicity of generally rectangular extruded members having a generally flat upper surface and lower surface having reinforcing, downwardly extending ribs thereon; and (ii) having first and second side connection means thereon, said downwardly extending ribs on said top side disposed substantially parallel to said first and second side connection means;

(b) a bottom side comprising:

(i) a multiplicity of generally rectangular extruded members having a generally flat lower surface substantially parallel with said top side, said bottom side having an upper surface having reinforcing upwardly extending ribs thereon;

(ii) each bottom side having first and second end connecting means, said upwardly extending ribs on said bottom side disposed substantially parallel to said first and second end connection means;

(iii) said ribs on said top side crossing said ribs on said bottom side at substantially 90° and having slots formed therein, said upwardly extending ribs on said bottom side locked in said slots providing reinforcing ribs extending from end to end and side to side to form said panel; and (iv) said panel having first and second end connection means along its end edges provided by said bottom side and first and second side connecting means along its side edges provided by the top side.

2. The panel in accordance with claim 1 wherein in said top side and said bottom side, said multiplicity of extruded members are joined together by welding.

3. The panel in accordance with claim 1 wherein said top sides are fabricated from an aluminum alloy.

4. A panel suitable for use in forming a temporary aircraft landing strip, the panel comprised of:

(a) a top side comprising:

(i) a multiplicity of generally rectangular extruded members fastened together to provide said top side having a generally flat upper surface and lower surface having reinforcing, downwardly extending ribs thereon; and (ii) having first and second side connection means thereon, said downwardly extending ribs on said top side disposed substantially parallel to said first and second side connection means;

(b) a bottom side comprising:

(i) a multiplicity of generally rectangular extruded members fastened together to provide said bottom side having a generally flat lower surface substantially parallel with said top side, said bottom side having an upper surface having reinforcing upwardly extending ribs thereon;

(ii) each bottom side having first and second end connecting means, said upwardly extending ribs on said bottom side disposed substantially parallel to said first and second end connection means;

(iii) said ribs on said top side crossing said ribs on said bottom side at substantially 90° and having slots formed therein, said upwardly extending ribs on said bottom side locked in said slots providing reinforcing ribs extending from end to end and side to side to form said panel having first and second end connection means along its end edges provided by said bottom side and first and second side connecting means along its side edges provided by the top side.

5. The panel in accordance with claim 4 wherein in said top side and said bottom side, said multiplicity of extruded members are joined together by welding.

6. The panel in accordance with claim 4 wherein said top sides are fabricated from an aluminum alloy.

7. In a temporary aircraft landing strip wherein a multiplicity of rectangular panels are locked together to form parallel rows of releasably joined panels disposed in a side-by-side relationship and in an end-to-end relationship, each panel having a first and second end connecting means along its end edges releasably joining said panels in an end-to end relationship to form a row and first and second side connecting means along its side edges, releasably connecting rows of said panels to form said strip, wherein said panel is comprised of:

(a) a top side comprising:

(i) a multiplicity of generally rectangular extruded members having a flat upper surface and lower surface having reinforcing, downwardly extending ribs thereon; and (ii) having first and second side connection means thereon, said downwardly extending ribs on said top side disposed substantially parallel to said first and second side connection means;

(b) a bottom side comprising:

(i) a multiplicity of generally rectangular extruded members having a generally flat lower surface substantially parallel with said top side, said bottom side having an upper surface having reinforcing upwardly extending ribs thereon;

(ii) each bottom side having first and second end connecting means, said upwardly extending ribs on said bottom side disposed substantially parallel to said first and second end connection means;

(iii) said ribs on said top side crossing said ribs on said bottom side at substantially 90° and having slots formed therein, said upwardly extending ribs on said bottom side locked in said slots providing reinforcing ribs extending from end to end and side to side to form said panel; and (iv) said panel having first and second end connection means along its end edges provided by said bottom side and first and second side connecting means along its side edges provided by the top side.

8. The panel in accordance with claim 7 wherein in said top side and said bottom side, said multiplicity of extruded members are joined together by welding.

9. The panel in accordance with claim 7 wherein said top sides are fabricated from an aluminum alloy.

* * * * *